US008971788B2

(12) United States Patent
Hayashi et al.

(10) Patent No.: US 8,971,788 B2
(45) Date of Patent: Mar. 3, 2015

(54) IMAGE FORMING APPARATUS

(75) Inventors: Kohei Hayashi, Okazaki (JP); Tomohiro Kato, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 165 days.

(21) Appl. No.: 13/602,764

(22) Filed: Sep. 4, 2012

(65) Prior Publication Data

US 2013/0071168 A1 Mar. 21, 2013

(30) Foreign Application Priority Data

Sep. 15, 2011 (JP) ..... 2011-201784

(51) Int. Cl.
*G03G 15/00* (2006.01)

(52) U.S. Cl.
CPC ..... *G03G 15/6564* (2013.01)
USPC ..... 399/394; 399/45; 399/66; 399/76; 399/77; 399/78; 399/195; 399/388; 399/389

(58) Field of Classification Search
CPC ..... G03G 15/6555; G03G 15/6558; G03G 15/6561; G03G 15/6564
USPC ..... 399/45, 66, 76, 77, 78, 195, 388, 389, 399/394
See application file for complete search history.

(56) References Cited

U.S. PATENT DOCUMENTS

| | | | | |
|---|---|---|---|---|
| 5,294,966 | A | 3/1994 | Shiokawa | |
| 2006/0209352 | A1* | 9/2006 | Motoyama | 358/296 |
| 2010/0061748 | A1 | 3/2010 | Ichikawa | |
| 2011/0052291 | A1* | 3/2011 | Iwakawa | 399/388 |

FOREIGN PATENT DOCUMENTS

| | | | |
|---|---|---|---|
| JP | 61-035463 | A | 2/1986 |
| JP | 05-016468 | A | 1/1993 |
| JP | 2001-042743 | A | 2/2001 |

(Continued)

OTHER PUBLICATIONS

Office Action (Decision to Grant Patent) issued by the Japanese Patent Office on Nov. 5, 2013 in corresponding Japanese Patent Application No. 2011-201784 and an English translation of the Official Action. (6 pages).

*Primary Examiner* — David Gray
*Assistant Examiner* — Michael Harrison
(74) *Attorney, Agent, or Firm* — Buchanan Ingersoll & Rooney PC

(57) ABSTRACT

An image forming apparatus includes an image forming unit, a sheet conveying unit, a TOD (Top of Data) control module for instructing the image forming unit to start generation of a toner image, a timing roller driving module for instructing the sheet conveying unit to start driving of the timing roller, an image synchronization module designed depending on the sheet conveying unit and the image forming unit, and a sheet information module for generating an image synchronization identifier for designating a pattern of image synchronization control related to printing of the toner image on the sheet, depending on a type of the sheet designated. The image synchronization module is activated when the formation of the toner image on the sheet has become possible, and activate each of the TOD control module and the timing roller driving module, with a relative time lag based on the image synchronization identifier.

7 Claims, 7 Drawing Sheets

(56) References Cited

FOREIGN PATENT DOCUMENTS

| | | | |
|---|---|---|---|
| JP | 2001-265191 | A | 9/2001 |
| JP | 2001-341873 | A | 12/2001 |
| JP | 2002-278406 | A | 9/2002 |
| JP | 2003-280485 | A | 10/2003 |
| JP | 2005-195807 | A | 7/2005 |
| JP | 2006-259872 | A | 9/2006 |
| JP | 2006-262399 | A | 9/2006 |
| JP | 2006-303569 | A | 11/2006 |
| JP | 2007-049470 | A | 2/2007 |
| JP | 2008-116828 | A | 5/2008 |
| JP | 2010-061003 | A | 3/2010 |

* cited by examiner

PATTERN 1: SHEET CONVEYANCE TIME PERIOD: T1 < IMAGE CONVEYANCE TIME PERIOD: T2

PATTERN 2: SHEET CONVEYANCE TIME PERIOD: T1 > IMAGE CONVEYANCE TIME PERIOD: T2

IMAGE FORMING APPARATUS

This application is based on Japanese Patent Application No. 2011-201784 filed with the Japan Patent Office on Sep. 15, 2011, the entire content of which is hereby incorporated by reference.

BACKGROUND OF THE INVENTION

1. Field of the Invention

The present invention relates to synchronization control between a toner image and a sheet of paper on which the toner image is fixed, in an electrophotographic image forming process, for example.

2. Description of the Related Art

In the electrophotographic image forming process, for example, a toner image is formed based on an input image, and a medium (sheet) on which the toner image to be formed is transferred is conveyed. Thus, it is necessary to perform control related to timing of generating (outputting) the toner image and control related to timing of conveying the sheet in such a manner that they are associated with each other. Such control in which the timing of generating (outputting) the toner image and the timing of conveying the sheet are associated with each other to form an input image in an appropriate position on the sheet is also referred to as "image synchronization control".

In the image synchronization control in an image forming process, each timing is controlled depending on a distance over which toner moves from a position where the toner image is formed to a position where the toner image is transferred to the sheet, and a speed thereof, as well as a distance over which the sheet moves from a position where the sheet is fed (typically the position of a timing roller) to the position where the toner image is transferred, and a speed thereof.

In response to the demand for reducing the costs of image forming apparatuses in recent years, an attempt to change or simplify various mechanisms in an image forming apparatus has been made, and accordingly, control specifications themselves are becoming more complicated. Meanwhile, there is also a demand that the development cycle of the image forming apparatus be shortened. In such an environment, there is a need to improve the efficiency of software development for realizing various types of control.

Some examples of related art concerning such software development of image forming apparatuses are as follows.

Japanese Laid-Open Patent Publication No. 2002-278406 discloses a technique for facilitating reuse of software by configuring software for performing sheet feed/conveyance control with individual components (software components). Japanese Laid-Open Patent Publication No. 2006-259872 discloses a technique for allowing common document processing to be adopted by accommodating a difference between an input source and an output destination, and providing a user with an interface through which document processing can be easily set.

Furthermore, as the related art concerning the image synchronization control in the image forming process as described above, Japanese Laid-Open Patent Publication No. 2008-116828 discloses a configuration having means for notifying a sheet feed/conveyance control unit of a time period from the time when a forward end of a first image is primarily transferred until the time when it reaches a secondary transfer position, to change a start time for driving a registration roller in accordance with the time of which the sheet feed/conveyance control unit was notified. The sheet feed/conveyance control unit can also make a request for a required image interval to an image forming unit based on a time period needed for driving the registration roller, and the image interval is changed in accordance with the request.

In the case of development to create software (control programs) individually in accordance with structural differences among various mechanisms in image forming apparatuses, it is necessary to develop programs dedicated for individual models in a number corresponding to the number of models. Therefore, efficient software development cannot be realized. Thus, software cannot be reused between models that adopt similar mechanisms, making it difficult to realize a shortened period of development work.

Japanese Laid-Open Patent Publication No. 2002-278406 described above merely discloses the concept of dividing software into components, and does not disclose a specific development technique for efficiently developing software for use in a plurality of models as described above. Furthermore, Japanese Laid-Open Patent Publication No. 2006-259872 described above proposes a software configuration for solving a problem in that similar types of processing were performed by different applications, and thus there were many duplications of processing or functions. Japanese Laid-Open Patent Publication No. 2006-259872, however, does not disclose an efficient development technique for developing software for use in a plurality of models as described above. Japanese Laid-Open Patent Publication No. 2008-116828 described above merely focuses on readily determining timing of starting a task, and does not disclose a specific development technique for efficiently developing software for use in a plurality of models as described above.

SUMMARY OF THE INVENTION

The present invention is directed to providing an image forming apparatus of which software is also reusable in another model.

An image forming apparatus according to one aspect of the present invention includes an image forming unit for forming a toner image based on an input image, a sheet conveying unit for conveying a sheet by driving a timing roller, a TOD (Top of Data) control module for instructing the image forming unit to start generation of the toner image, a timing roller driving module for instructing the sheet conveying unit to start driving of the timing roller, an image synchronization module for activating the TOD control module and the timing roller driving module, the image synchronization module being designed depending on the sheet conveying unit and the image forming unit, and a sheet information module for generating an image synchronization identifier for designating a pattern of image synchronization control related to printing of the toner image on the sheet, depending on a type of the sheet designated. The image synchronization module is configured to be activated when formation of the toner image on the sheet has become possible, and activate each of the TOD control module and the timing roller driving module, with a relative time lag based on the image synchronization identifier.

Preferably, the image synchronization module is configured to switch, based on the image synchronization identifier, between a first mode in which a driving start signal for instructing start of driving the timing roller is generated from the timing roller driving module after the image synchronization signal for instructing start of the formation of the toner image is generated from the TOD control module and a second mode in which the image synchronization signal is generated from the TOD control module after the driving start signal is generated from the timing roller driving module.

More preferably, the image forming apparatus further includes a sheet control module for controlling a sequence related to an image forming process for a sheet. The sheet control module is configured to activate the image synchronization module when the formation of the toner image in the image forming unit and conveyance of the sheet by the sheet conveying unit are both possible.

More preferably, the sheet control module is configured to be activated as a first task activated in a first cycle. Each of the image synchronization module, the TOD control module, and the timing roller driving module is configured to be activated as a second task activated in a second cycle shorter than the first cycle.

More preferably, the image synchronization module as a module interface includes a function constantly periodically activated from the second task, a function for receiving starting and stopping of the image synchronization control, a function for revealing a control state of the image synchronization module itself, and a function for receiving initialization at the time of system start-up.

Preferably, information designated by the image synchronization identifier is determined based on an image formation position in the image forming unit and a position where the timing roller is disposed in the sheet conveying unit.

Preferably, the sheet information module is configured to determine the image synchronization identifier depending on a color mode.

Preferably, the image synchronization module is designed to have, as parameters, a time period from time when formation of the toner image on the sheet has become possible until start of the first mode or the second mode, a time period from start of the first mode until generation of the image synchronization signal, a time period from generation of the image synchronization signal until generation of the driving start signal, a time period from start of the second mode until generation of the driving start signal, and a time period from generation of the driving start signal until generation of the image synchronization signal.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described in detail with reference to the drawings. It is noted that identical or corresponding parts in the figures are denoted by identical symbols, and description thereof will not be repeated.

[A. Overall Structure of Apparatus]

A structure of an image forming apparatus 1 according to the present embodiment will be described first. Image forming apparatus 1 according to the present embodiment may be used for any purposes so long as it has a structure for executing an electrophotographic image forming process. That is, image forming apparatus 1 can be implemented as any of a printer, a copier, a facsimile, an MFP (Multi-Functional Peripheral), and the like. The following description shows an example where image forming apparatus 1 is implemented as an MFP having such functions as a scanner, a copier, a printer, and the like.

Figure 1:
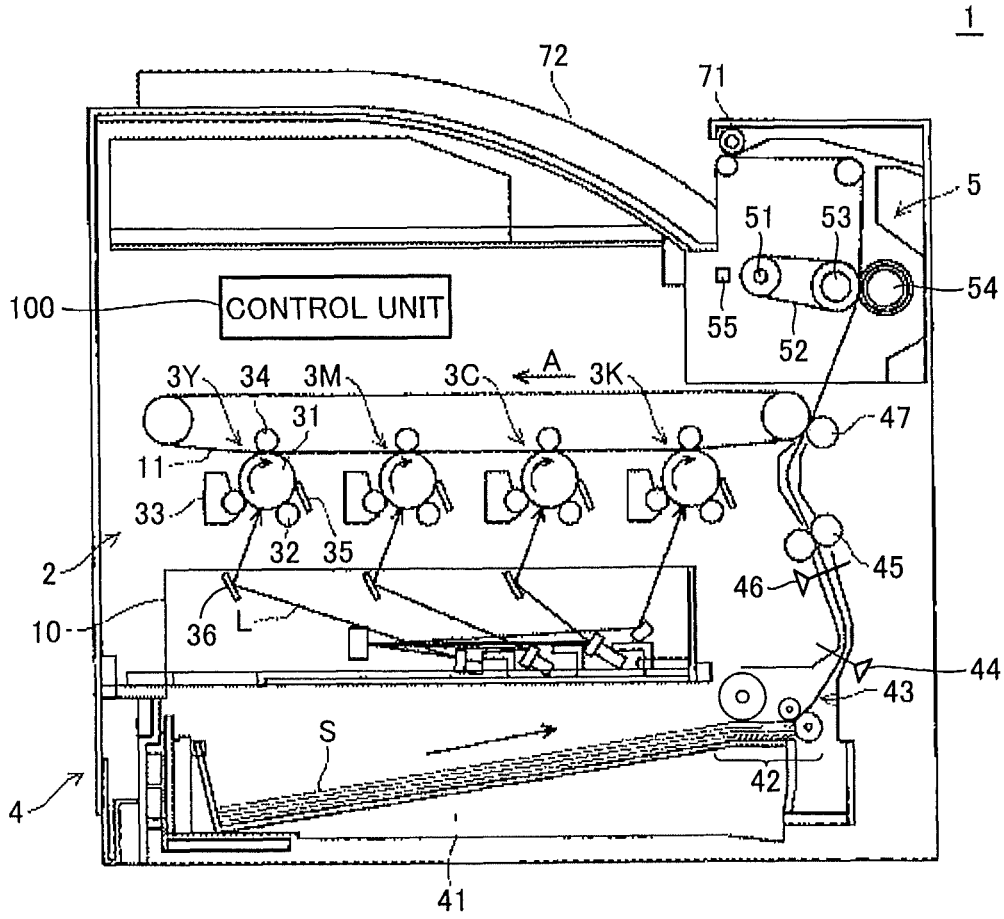
FIG. 1 is a schematic diagram showing a schematic structure of an image forming apparatus according to an embodiment of the present invention.

FIG. 1 is a schematic diagram showing a schematic structure of image forming apparatus 1 according to the embodiment of the present invention. By way of example, image forming apparatus 1 shown in FIG. 1 is capable of executing a tandem-type electrophotographic image forming process. Image forming apparatus 1 includes, as main structural elements, a print engine 2, a feed unit 4, a fixing device 5, and a control unit 100. Image forming apparatus 1 further includes a scanner, an ADF (Automatic Document Feeder), and the like, though not shown.

Print engine 2 corresponds to an image forming unit for forming a toner image based on an input image, and is constituted of imaging units 3Y, 3M, 3C, and 3K that form toner images of yellow (Y), magenta (M), cyan (C), and black (BK), respectively. Imaging units 3Y, 3M, 3C, and 3K are disposed in the order of Y→M →C→BK from upstream, along an intermediate transfer belt 11 that circulates in a direction indicated by arrow A in FIG. 1.

Each of imaging units 3Y, 3M, 3C, and 3K has a photoconductor drum 31. A (monochrome) toner image of a corresponding color is developed on photoconductor drum 31. The developed toner image of each color is transferred by a primary transfer roller 34 onto intermediate transfer belt 11 in a contact position between corresponding imaging unit 3 and intermediate transfer belt 11. Transfer positions of the toner images formed by imaging units 3Y, 3M, 3C, and 3K are in synchronization with one another, and therefore, as intermediate transfer belt 11 passes through each of imaging units 3Y, 3M, 3C, and 3K, the toner images of the various colors are sequentially superimposed on one another, ultimately forming a full-color toner image on intermediate transfer belt 11.

More specifically, each of imaging units 3Y, 3M, 3C, 3K includes a charging unit 32 for uniformly charging photoconductor drum 31, and a development portion 33 for developing an electrostatic latent image, which is formed by exposing a surface of photoconductor drum 31 to light corresponding to an image to be reproduced, using a toner of the corresponding color. The toner images developed by a series of operations of these members are primarily transferred by primary transfer roller 34 onto intermediate transfer belt 11. Exposure of photoconductor drum 31 is performed by an exposure control device 10. Exposure control device 10 is provided with an instruction in accordance with a print job or the like from control unit 100. Toner remaining on photoconductor drum 31 after the primary transfer is removed by a cleaning unit 35 disposed downstream, and is collected into a not-shown waste toner container or the like.

The full-color toner image thus formed on intermediate transfer belt 11 is transferred as a whole to a sheet S as a medium, by a secondary transfer roller 47 disposed downstream. Sheet S having the toner image transferred thereon then passes through a fixing device 5 disposed downstream, whereby the transferred toner image is fixed thereon. Finally, sheet S having the toner image fixed thereon is conveyed by an ejection roller 71 or the like to be ejected onto an ejection tray 72.

Fixing device 5 includes a heating element 51, a heating belt 52, a heating roller 53, and a pressurizing roller 54, and performs temperature adjustment by detecting a surface temperature of heating belt 52 or the like with a thermistor 55.

Sheets S are typically contained in a feed cassette 41 of feed unit 4 provided in a lower portion of the apparatus, and are conveyed one by one to secondary transfer roller 47 from feed cassette 41. A first-stage feed roller 42, a feed sensor 44, a timing sensor 46, and a timing roller 45 are provided along a conveyance path 43 from feed cassette 41 to secondary transfer roller 47. As described above, image forming apparatus 1 according to the present embodiment has a sheet conveying unit that conveys a sheet by driving timing roller 45.

Toner remaining on intermediate transfer belt 11 after the secondary transfer is removed from intermediate transfer belt 11 with a not-shown cleaning blade, and is collected into a not-shown waste toner container or the like.

As will be described below, image forming apparatus 1 according to the present embodiment has a configuration for performing control in which timing of generating (outputting) a toner image in print engine 2 and timing of conveying sheet S are associated with each other to form an input image in an appropriate position on sheet S (image synchronization control) through software for realizing a shortened delivery time of development work, while avoiding an influence of dependence upon model.

[B. Configuration of Control Unit]

Figure 2:
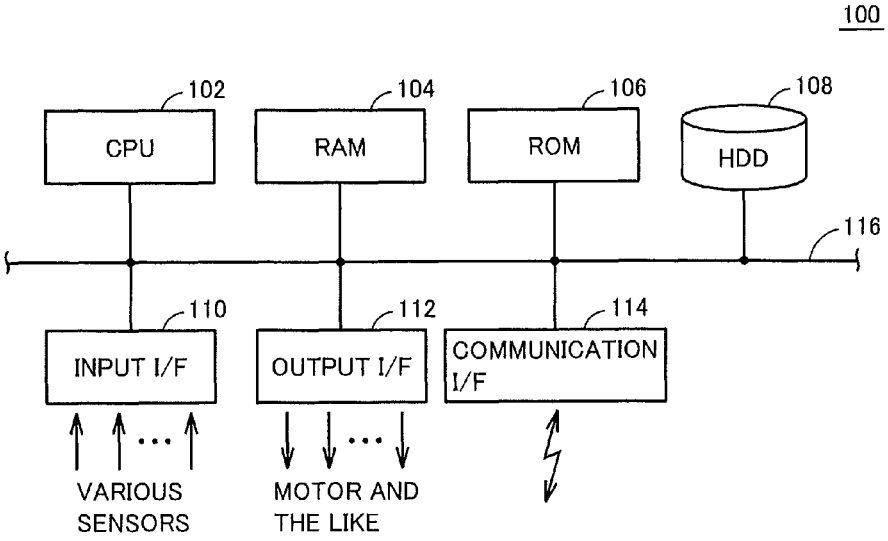
FIG. 2 is a block diagram showing a functional configuration of a control unit in the image forming apparatus according to the embodiment of the present invention.

FIG. 2 is a block diagram showing a functional configuration of control unit 100 in image forming apparatus 1 according to the embodiment of the present invention.

Control unit 100 of image forming apparatus 1 shown in FIG. 2 controls the entire image forming apparatus 1. That is, control unit 100 controls print engine 2, feed unit 4, fixing device 5, means for conveying sheet S, and the like.

Control unit 100 mainly includes a CPU (Central Processing Unit) 102, which corresponds to a processing unit, a RAM (Random Access Memory) 104 that stores data in a volatile manner, a ROM (Read Only Memory) 106 that stores data in a non-volatile manner, an HDD (Hard Disk Drive) 108 that stores a large volume of data, an input interface (I/F) 110, an output interface (I/F) 112, and a communication interface (I/F) 114. These components are connected to one another via an internal bus 116.

In control unit 100, various types of control, including the below-described image synchronization control, is realized by CPU 102 loading programs (a group of modules) for executing various types of processing stored in advance in ROM 106 or the like into RAM 104 or the like, for execution. RAM 104 is used as a work memory, and temporarily stores, for example, image data to be processed and various types of variable data, in addition to the executed program itself.

Input interface 110 receives input signals from various sensors constituting print engine 2 or the like, and transmits the received information to CPU 102. Output interface 112 outputs an instruction to instruct a load such as a motor or a clutch (or a driver for driving the motor or clutch) constituting print engine 2 or the like to operate or stop, for example, in response to an internal command from CPU 102 or the like.

Communication interface 114 exchanges data with, for example, an operation panel and an external device not shown.

Although control functions of control unit 100 are typically realized by CPU 102 executing programs, part of or all of the control functions may be implemented by dedicated hardware or an LSI (Large Scale Integration).

[C. Image Synchronization Control]

Figure 3:
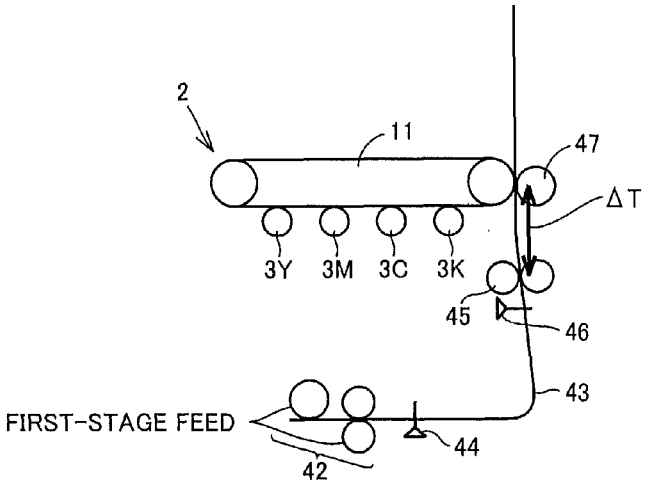
FIG. 3 is a schematic diagram showing a cross-sectional structure related to secondary transfer in the image forming apparatus according to the embodiment of the present invention.
Figure 4A:
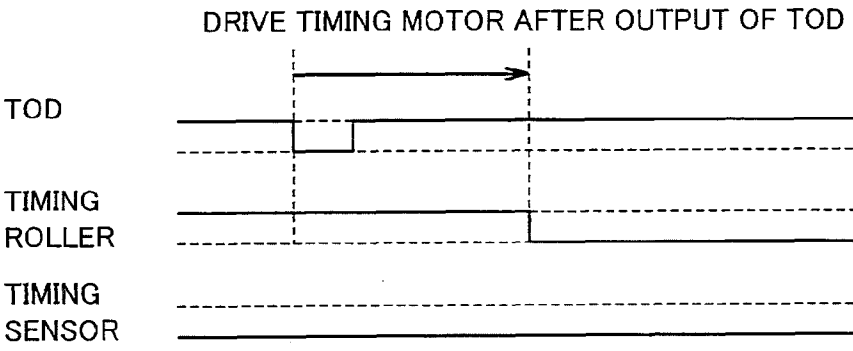
FIGS. 4A and 4B are exemplary timing charts of image synchronization control in the image forming apparatus according to the embodiment of the present invention.
Figure 4B:
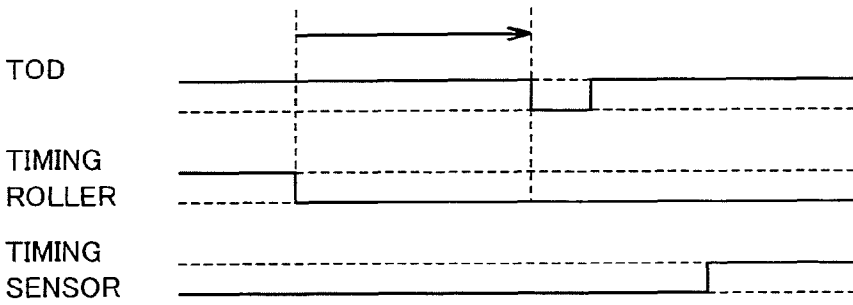

Referring next to FIG. 3 and FIGS. 4A and 4B, the image synchronization control in image forming apparatus 1 according to the present embodiment will be described.

FIG. 3 is a schematic diagram showing a cross-sectional structure related to secondary transfer in image forming apparatus 1 according to the embodiment of the present invention. FIGS. 4A and 4B are exemplary timing charts of image synchronization control in image forming apparatus 1 according to the embodiment of the present invention.

Referring to FIG. 3, the toner images developed on respective photoconductor drums 31 of imaging units 3Y, 3M, 3C, and 3K are sequentially superimposed on one another and transferred to intermediate transfer belt 11 (primary transfer unit), and are then conveyed to secondary transfer roller 47, where they are transferred to sheet S. Print engine 2 generates a toner image based on an image synchronization signal (TOD (Top of Data) signal; also referred to as an "image forward end signal"), and the generated toner image is conveyed to secondary transfer roller 47 (secondary transfer unit) and transferred to a target position on sheet S.

Meanwhile, during conveyance of sheet S fed from feed cassette 41, first-stage feed roller 42 stops after a prescribed period of time from sensing of sheet S by timing sensor 46. Skew correction is then made by forming a loop in sheet S near timing roller 45. Furthermore, timing roller 45 is driven in synchronization with timing of forming the toner image based on the image synchronization signal (TOD signal), causing sheet S to be conveyed to secondary transfer roller 47 (secondary transfer unit). In this way, synchronization is achieved between the toner image and sheet S onto which the toner image is to be fixed.

This synchronization operation between the toner image and sheet S onto which the toner image is to be fixed varies depending on a physical positional relation between print engine 2 and a mechanism for conveying sheet S, a conveyance speed, and the like. Thus, in the case of adopting the structure as shown in FIG. 3, control timing in the image synchronization control varies depending on a relative relation between a time period T1 needed for sheet S to be conveyed from timing roller 45 to secondary transfer roller 47 (secondary transfer unit) and a time period T2 needed for the toner images developed on respective photoconductor drums 31 of imaging units 3Y, 3M, 3C, and 3K to be conveyed to secondary transfer roller 47 (secondary transfer unit) from when they are formed on intermediate transfer belt 11 (primary transfer unit). Each of time periods T1 and T2 is set in accordance with a conveyance distance and the conveyance speed.

The timing chart of the image synchronization control shown in FIG. 4A shows a case where time period T1<time period T2. In this case, the time period needed for the toner image to reach secondary transfer roller 47 (secondary transfer unit) is longer than the time period needed for sheet S to reach secondary transfer roller 47 (secondary transfer unit), and therefore, the image synchronizing signal (TOD signal) is output in advance of starting conveyance of sheet S.

That is, as shown in FIG. 4A, after a prescribed period of time from the output of the image synchronization signal (TOD signal), the formed toner image is conveyed to secondary transfer roller 47 (secondary transfer unit). Meanwhile, after a prescribed period of time from the output of the image synchronization signal (TOD signal), driving of timing roller 45 is started to convey sheet S, while taking into account the time period needed for the toner image to reach secondary transfer roller 47 (secondary transfer unit). In this way, synchronization is achieved between the toner image and sheet S onto which the toner image is to be fixed, based on the image synchronization signal (TOD signal).

Conversely, the timing chart of the image synchronization control shown in FIG. 4B shows a case where time period T1>time period T2. In this case, the time period needed for sheet S to reach secondary transfer roller 47 (secondary transfer unit) is longer than the time period needed for the toner image to reach secondary transfer roller 47 (secondary transfer unit), and therefore, the image synchronizing signal (TOD signal) is output after conveyance of sheet S is started in advance.

That is, as shown in FIG. 4B, the image synchronization signal (TOD signal) is output to start formation of a toner image, while taking into account the time period needed for a forward end of sheet S to reach secondary transfer roller 47 (secondary transfer unit) from the start of conveyance of sheet S by driving timing roller 45. In this way, synchronization is achieved between the toner image and sheet S onto which the toner image is to be fixed, based on driving of timing roller 45.

[D. Problem Related to Software Development]

As described above, the timing of generating (outputting) a toner image (timing of outputting the TOD signal) and the timing of conveying sheet S (timing of starting driving of timing roller 45) depend on the distance from the position where a toner image is formed to the position of transfer to sheet S, and the distance from timing roller 45 to the position of transfer to sheet S. Therefore, as described above, it is necessary to perform different types of synchronization control as follows: (1) driving of timing roller 45 is started after output of the image synchronization signal (TOD signal); and (2) the image synchronization signal (TOD signal) is output after driving of timing roller 45 is started.

Such a control sequence in the image synchronization control needs to be changed depending on a mechanism structure in the target image forming apparatus. This control sequence is also changed depending on a color mode (distinction between color printing and monochrome printing). Therefore, depending on the structure of the target image forming apparatus, complicated control is required to switch the control sequence for each sheet to be printed on. In such a case, it has conventionally been necessary to customize control programs, and a common control program could not be adopted between different models.

As an approach to solve this problem, software development has sometimes been made by using either of the methods described below.

The first one is a method in which a module is designed for each of the rollers involved in the image forming process. Each of the roller modules that controls the corresponding roller has its own activation/stop timing as a parameter, and controls a load (the motor or the clutch) when designated timing is reached. In response to this, sheet S is conveyed by each of the rollers.

One advantage of this method is that since each roller can be controlled independently, the method is not affected even when the conveyance distance of sheet S from timing roller 45 to secondary transfer roller 47 (secondary transfer unit) changes, or the distance between these rollers changes, as described above.

However, if the number of rollers used in the image forming process increases to increase the number of rollers to be controlled, a plurality of roller modules that perform similar types of processing will be required, which also makes the control complicated. This is because, for every roller module, there is a set of processing for determining the control timing and processing for controlling the load. Moreover, because of reduction in the costs of the apparatuses, there is an increasing number of configurations in which each roller cannot be driven independently (for example, a plurality of rollers are driven by a common motor). In such a case, coordinated processing among a plurality of roller modules is needed, which require considerable design changes to be made.

Accordingly, the first method is more disadvantageous rather than advantageous in terms of software development, owing to the recent reduction in the costs of the apparatuses.

The second one is a method in which software is configured to be divided into a sequence module responsible for the processing of controlling timing, and a device driver module responsible for the processing of controlling a load. In this case, the sequence module has a control sequence and activation/stop timing for each load as parameters, and gives an instruction to the device driver in accordance with the sequence. The device driver module controls the load in accordance with the driving instruction from the sequence module. For example, when a sheet has reached an activation position of a feed roller, an activation instruction is given to a feed motor for driving the feed roller to start conveyance by the feed roller, whereupon the module of the feed motor that has received the instruction controls activation of the feed motor.

This method is advantageous in that under circumstances where the control sequence does not significantly change (for example, feed→skew correction→TOD output→activation of registration roller), the coordinated processing throughout the entire system can be easily achieved. By adopting this method, even if the driving structure or the distance between rollers in the image forming process changes, changes may only be made to the parameters, and thus the disadvantage of the above-described first method can be overcome. Moreover, the device driver module can also be divided into components, which facilitates reuse thereof.

As described above, however, if the control sequence itself changes, the sequence module needs to be newly designed, which affects the entire system. Thus, the second method has had a problem in that reuse of the sequence module between different models is not promoted.

As described above, with the conventional software designing techniques, software needs to be customized in accordance with a model (system related to the image forming process). According to the present embodiment, this problem is solved by adopting a software configuration as will be described below.

[E. Module Configuration]

A module configuration to be installed on control unit 100 in image forming apparatus 1 according to the present embodiment will be described next.

Figure 5:
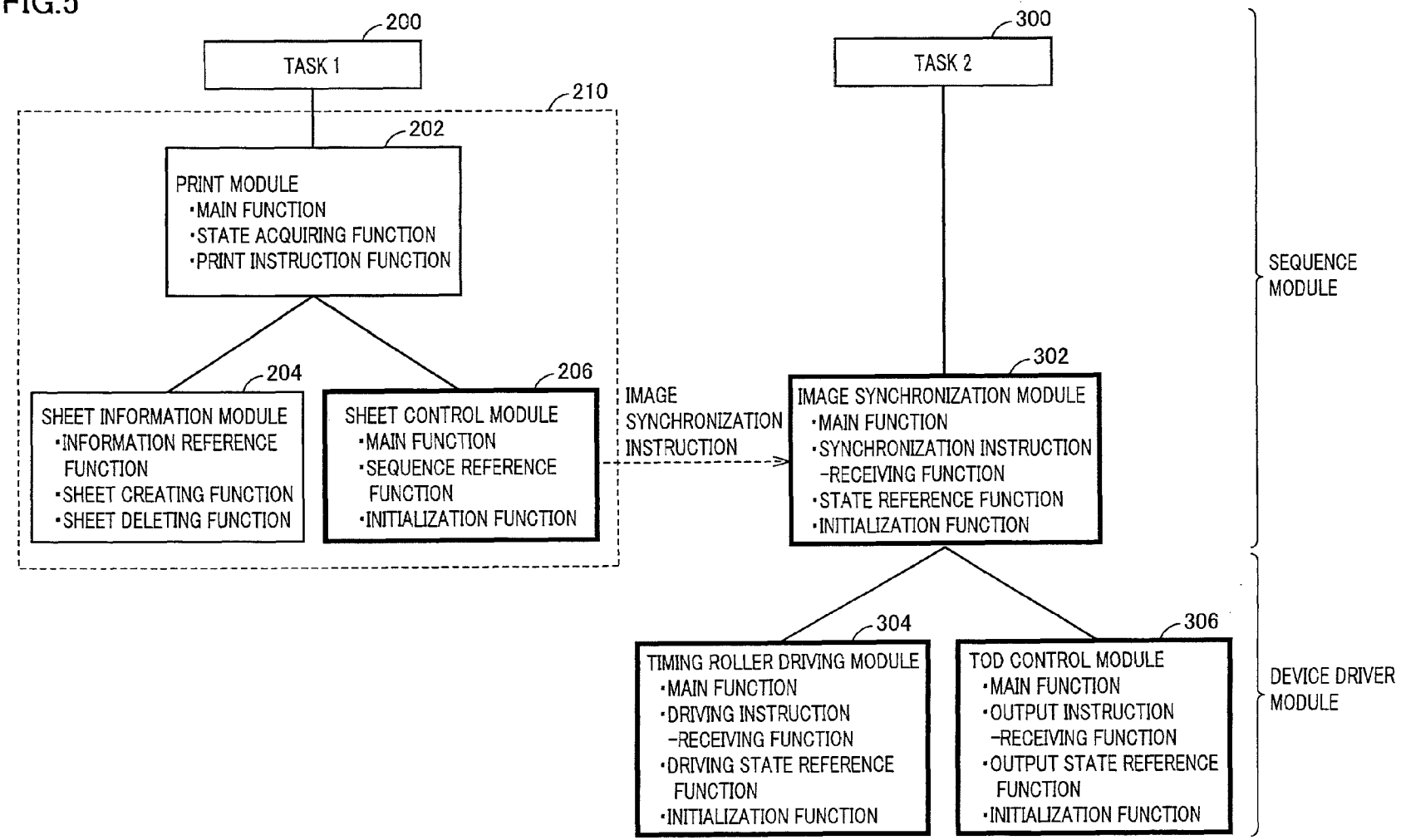
FIG. 5 is a schematic diagram showing a module configuration of an image synchronization control-related program installed on the image forming apparatus according to the embodiment of the present invention.

FIG. 5 is a schematic diagram showing a module configuration of an image synchronization control-related program installed on image forming apparatus 1 according to the embodiment of the present invention. In FIG. 5, each of the rectangular blocks shows an independent module having data and an operation.

Referring to FIG. 5, in the present embodiment, modules are activated from two independent periodic tasks (task 1 and task 2). By way of example, task 1 represents a task that is activated in a reference cycle, and task 2 represents a task that is activated in a time cycle shorter than that of task 1.

A print module 202, which is a main module of the present program, is periodically activated from task 1. Modules invoked from print module 202 include a sheet information module 204 and a sheet control module 206. In addition to task 1, each of print module 202, sheet information module 204, and sheet control module 206 corresponds to a sequence module responsible for the processing of timing control related to the image synchronization control.

Print module 202 is a module that exercises overall control of all the print sequences in image forming apparatus 1. More specifically, print module 202 includes a main function, a state acquiring function, and a print instruction function. The main function is periodically activated from task 1. The state acquiring function passes a state of the print sequences to a state management module that exercises overall control of the entire system of image forming apparatus 1. The print instruction function receives a print command given from an external controller.

Upon reception of the print command, print module 202 holds information of the print instruction as internal data of print module 202 by using the print instruction function, and also sets in sheet information module 204 information for each single sheet for which the print instruction has been issued by referring to the held information with the main function.

Sheet information module 204 is a module that queues the information for each single sheet, and functions like a database, That is, sheet information module 204 generates, in accordance with the type of a designated sheet, an image synchronization identifier for designating a pattern (sequence) of the image synchronization control related to printing of a toner image on that sheet. Here, the information for each single sheet includes a color mode, the kind of sheet, a sheet ID, a conveyance speed, and the image synchronization identifier. The image synchronization identifier represents information for specifying image synchronization control (image synchronization sequence) for the corresponding single sheet. That is, sheet information module 204 determines the corresponding image synchronization identifier in accordance with the color mode, the kind of sheet, the sheet ID, the conveyance speed, and the like.

Sheet information module 204 creates such information in a FIFO (First-In First-Out) order for queuing, every time it receives a print instruction. A memory area for holding these created information may be an area statically secured in advance or a dynamically created area. More specifically, sheet information module 204 includes an information reference function that reveals designated sheet information of a specific sheet, a sheet creating function that sets the sheet information of the designated sheet in a sheet queue, and a sheet deleting function that deletes the sheet information of the designated sheet from the sheet queue. Sheet information module 204 receives a sheet creating instruction and a sheet deleting instruction from print module 202.

Sheet control module 206 is a module that is activated from print module 202, and performs sequence control for each single sheet. Sheet control module 206 controls a sequence related to the image forming process for a sheet. Here, sheet control module 206 is a re-entrant module, and a plurality of sheet control modules 206 can be asynchronously invoked from print module 202. Therefore, for each single sheet, each piece of sheet information and necessary information are set by print module 202, and then sheet control module 206 is activated. That is, sheet control modules 206 in a number corresponding to the number of sheets included in the print instruction are activated in response to a print instruction. Sheet control module 206 then activates an image synchronization module 302 when formation of a toner image in print engine 2 (image forming unit) and conveyance of a sheet by the sheet conveying unit are both possible.

More specifically, sheet control module 206 includes a main function activated from print module 202, a sequence reference function that returns a state of the sequence for each single sheet to print module 202, and an initialization function. Sheet control module 206 controls the state for each single sheet, and upon transition to an image synchronization state, it provides image synchronization module 302 with an image synchronization instruction.

It is noted that print module 202, sheet information module 204, and sheet control module 206 can be installed as a single module 210.

Image synchronization module 302 is periodically activated from task 2 that is activated in a time cycle shorter than that of task 1. Image synchronization module 302 is designed depending on the sheet conveying unit and the image forming unit (print engine 2), and activates a TOD control module 306 and a timing roller driving module 304. Image synchronization module 302 corresponds to the above-described two types of image synchronization sequences shown in FIGS. 4A and 4B, and determines which of the image synchronization sequences is to be executed, based on the image synchronization identifier. That is, sheet control module 206 is activated as the first task that is activated in the first cycle, and image synchronization module 302, TOD control module 306, and timing roller driving module 304 are activated as the second task that is activated in the second cycle shorter than the first cycle.

Image synchronization module 302 is a sequence module responsible for the processing of timing control related to the image synchronization control, and determines an image synchronization sequence to be executed in accordance with the instruction from sheet control module 206 to perform the image synchronization control for each single sheet.

Here, image synchronization module 302 is activated when formation of a toner image on the sheet has become possible, and also activates each of TOD control module 306 and timing roller driving module 304, with a relative time lag based on the image synchronization identifier.

More specifically, after the TOD signal for instructing the start of generation of the toner image is generated from TOD control module 306, image synchronization module 302 switches, based on the image synchronization identifier, between a first mode in which a driving start signal for instructing the start of driving timing roller 45 is generated from timing roller driving module 304 (see FIG. 4A) and a second mode in which the TOD signal is generated from TOD control module 306 after the driving start signal is generated from timing roller driving module 304 (see FIG. 4B).

More specifically, image synchronization module 302 as a module interface includes a main function, a synchronization instruction-receiving function, a state reference function, and an initialization function. The main function is periodically activated from task 2.

The synchronization instruction-receiving function receives the image synchronization instruction from sheet control module 206. That is, the synchronization instruction-receiving function receives starting and stopping of the image synchronization control.

The state reference function reveals a state of the image synchronization sequence. That is, the state reference function represents a function that reveals a control state of image synchronization module 302 itself. The initialization function receives initialization at the time of system start-up.

Image synchronization module 302 receives the image synchronization identifier of the designated sheet in accordance with the image synchronization instruction from sheet control module 206, and determines an image synchronization control sequence to be executed, in accordance with the information of the image synchronization identifier. Image synchronization module 302 then performs the image synchronization control in accordance with the determined sequence, using timing roller driving module 304 and TOD control module 306.

Each of timing roller driving module 304 and TOD control module 306 is a device driver module responsible for the processing of controlling a load.

Timing roller driving module 304 is a device driver module that is activated from image synchronization module 302, and performs control of driving the load (timing roller 45). That is, timing roller driving module 304 instructs the sheet conveying unit to start driving of timing roller 45.

More specifically, timing roller driving module 304 has a main function that is periodically activated from image synchronization module 302, a driving instruction-receiving function that receives a driving instruction, a driving state reference function that reveals its own driving state, and an initialization function. Timing roller driving module 304 controls driving of the load upon reception of the driving instruction.

TOD control module 306 is a device driver module that is activated from image synchronization module 302, and controls the output of the TOD signal. That is, TOD control module 306 instructs print engine 2, which corresponds to the image forming unit, to start generation of the toner image.

More specifically, TOD control module 306 has a main function that is periodically activated from image synchronization module 302, an output instruction-receiving function that receives an output instruction, an output state reference function that reveals its own output state, and an initialization function. TOD control module 306 outputs the TOD signal upon reception of the instruction.

[F. Control Operation]

Figure 6:
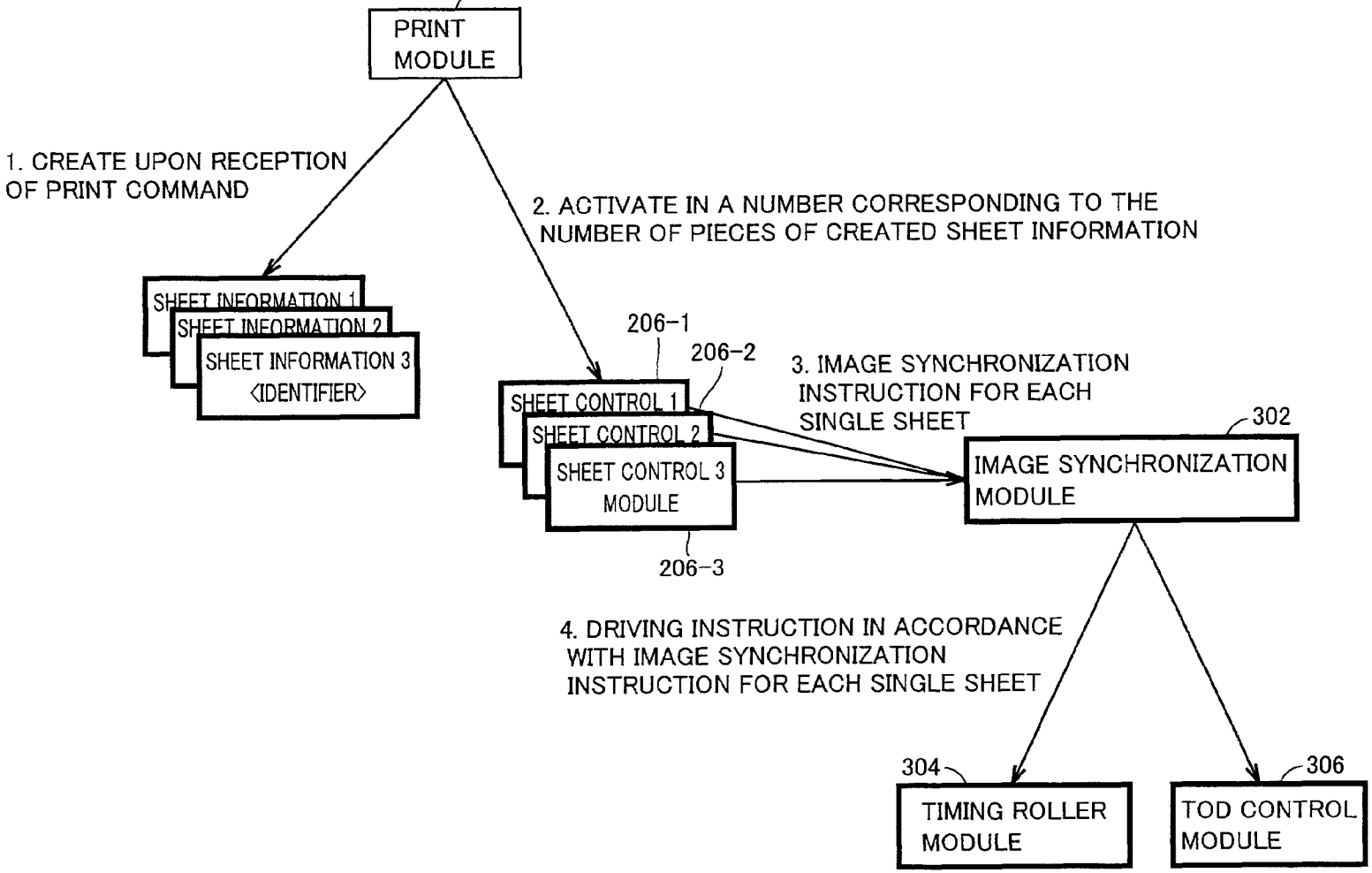
FIG. 6 is a schematic diagram showing collaboration among modules constructing the image synchronization control-related program installed on the image forming apparatus according to the embodiment of the present invention.

Coordinated operation during execution by the module configuration shown in FIG. 5 will be described next. FIG. 6 is a schematic diagram showing collaboration among modules constructing the image synchronization control-related program installed on image forming apparatus 1 according to the embodiment of the present invention.

Referring to FIG. 6, print module 202 outputs a sheet information creating instruction to sheet information module 204 upon reception of a print command, and creates a piece of sheet information for each sheet to be printed on (step 1). Here, each piece of sheet information includes an image synchronization identifier.

Print module 202 subsequently activates sheet control modules 206 as many as the pieces of sheet information created in step 1 (step 2). Here, the information for each sheet is set in each sheet control module 206.

Each of activated sheet control modules 206 executes a series of sequences related to feeding, conveyance, and ejection of the sheet, and when the image synchronization control has become executable, each sheet control module 206 provides image synchronization module 302 with an image synchronization instruction (step 3). Image synchronization module 302 determines a sequence that matches image synchronization identifier information in accordance with the instruction, and activates each of timing roller driving module 304 and TOD control module 306, following the order in accordance with the determined sequence (step 4). The image synchronization control is executed through the series of processing as described above.

Figure 7:
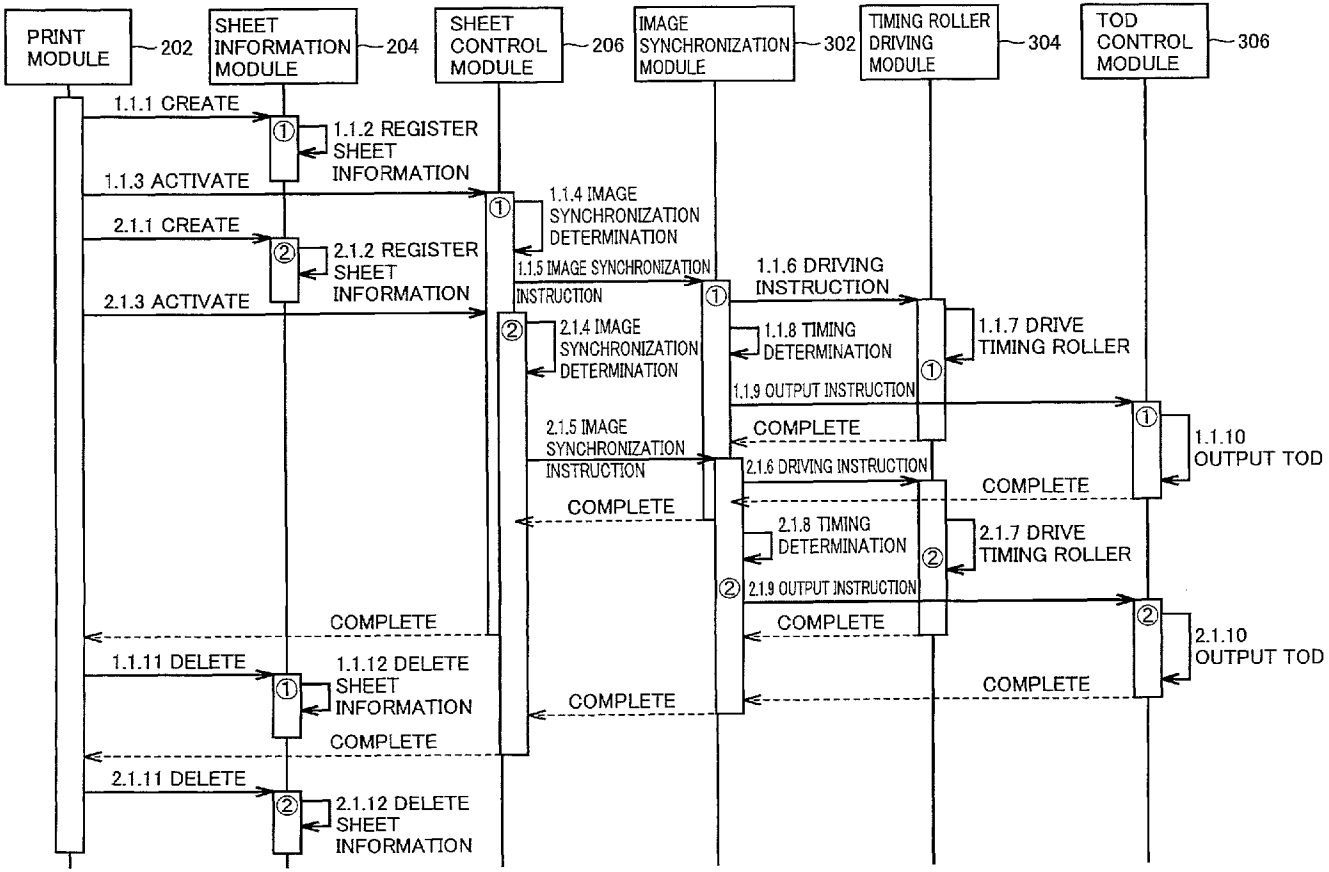
FIG. 7 is a sequence diagram showing processing procedures among the modules implemented by the image synchronization control-related program installed on the image forming apparatus according to the embodiment of the present invention.

Processing procedures among the modules implemented by the program related to the above-described image synchronization control will now be described. FIG. 7 is a sequence diagram showing processing procedures among the modules implemented by the image synchronization control-related program installed on image forming apparatus 1 according to the embodiment of the present invention. FIG. 7 shows, by way of example, an image synchronization sequence for a case where two sheets are printed on.

Initially, upon reception of a print command, print module 202 is activated to instruct sheet information module 204 to create sheet information (sequence 1.1.1). In response to the instruction, sheet information module 204 creates sheet information included in a print instruction (sequence 1.1.2). Here, sheet information module 204 determines an image synchronization identifier that designates the type of image synchronization sequence, based on a designated color mode and a preset position parameter of the mechanism, whereby the image synchronization identifier is registered together with the sheet information.

Next, print module 202 sets necessary information based on the created sheet information, and then activates sheet control module 206 (sequence 1.1.3). Sheet control module 206 executes a series of sequences related to feeding, conveyance, and ejection of the sheet, and determines whether the image synchronization control has become executable or not (image synchronization determination) (sequence 1.1.4). When the image synchronization control has become executable, sheet control module 206 outputs an image synchronization instruction to image synchronization module 302 (sequence 1.1.5).

Image synchronization module 302 determines image synchronization control to be executed (image synchronization sequence) based on the instructed image synchronization identifier, and issues a timing roller driving instruction (sequence 1.1.6) and a TOD output instruction (sequence 1.1.9). Image synchronization module 302 determines issuance timing to issue the timing roller driving instruction and the TOD output instruction (sequence 1.1.8). This order of executing sequences 1.1.6 to 1.1.10 varies depending on the image synchronization identifier (image synchronization sequence).

Timing roller driving module 304 that has received the timing roller driving instruction performs load control (driving of timing roller 45) (sequence 1.1.7), and upon termination of the load control, it returns a completion notification to image synchronization module 302. Similarly, TOD control module 306 that has received the TOD output instruction performs load control (output of a TOD signal) (sequence 1.1.9), and upon termination of the load control, it returns a completion notification to image synchronization module 302.

Image synchronization module 302 receives the completion notification of each load control, and returns its own sequence completion to sheet control module 206. Sheet control module 206 receives the completion notification from image synchronization module 302 and makes a transition to a state of controlling ejection of the sheet. After completion of all the sheet control sequences to ejection, image synchronization module 302 returns its own sequence completion to print module 202.

Upon reception of the completion notification of the sheet control sequence, print module 202 outputs, to sheet information module 204, an instruction to delete the completed sheet from the sheet information (sequence 1.1.11). Upon reception of the instruction to delete, sheet information module 204 deletes the corresponding sheet information from its own queue (sequence 1.1.12).

The same processing as that of sequences 1.1.1 to 1.1.12 is executed the number of times corresponding to the number of sheets to be printed on. It is noted that a series of these sequences themselves is executed in parallel.

After all the sheets have been deleted, print module 202 is terminated, completing the printing operation of the system.

[G. Development Environment]

Next, a development environment for software related to image synchronization control to be installed on image forming apparatus 1 as described above will be described.

Figure 8:
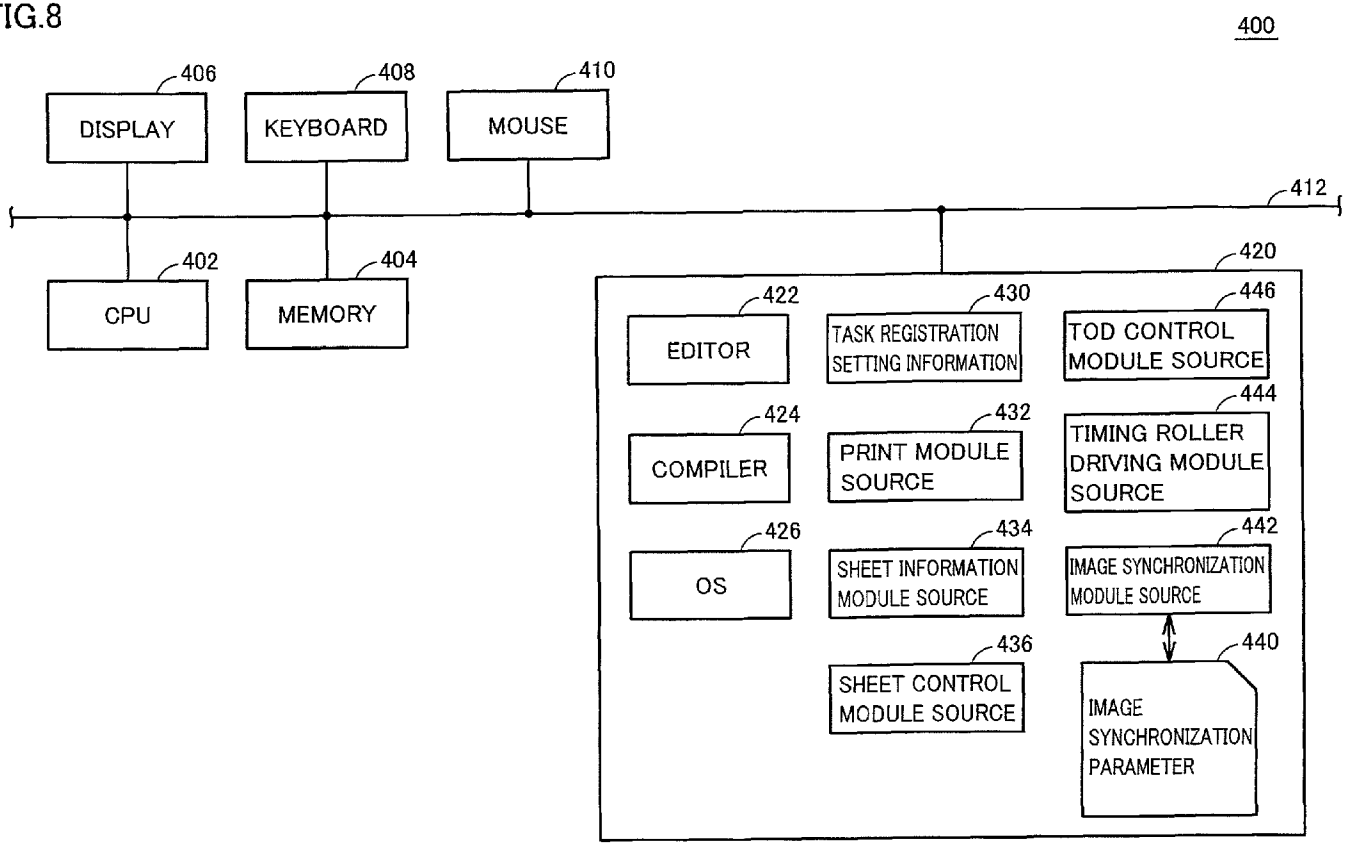
FIG. 8 is a block diagram showing a configuration for developing image synchronization control-related software to be installed on the image forming apparatus according to the embodiment of the present invention.

FIG. 8 is a block diagram showing a configuration for developing image synchronization control-related software to be installed on image forming apparatus 1 according to the embodiment of the present invention. FIG. 8 shows, as one example of a development environment according to the present embodiment, an example of a configuration in which applications are installed on a personal computer. FIG. 8 shows a personal computer 400 that provides a development environment directed to image forming apparatus 1 according to the present embodiment. Personal computer 400 includes a CPU 402, a memory 404, a display 406, a keyboard 408, a mouse 410, and a hard disk 420 as hardware components. These components are connected to one another via an internal bus 412.

Various applications stored in hard disk 420 are loaded into memory 404 and executed on CPU 402, allowing software related to image synchronization control to be developed in accordance with a user's operation.

Hard disk 420 stores an editor 422, a compiler 424, and an OS (Operating System) 426. Editor 422 provides a function of editing the below-described various sources, and compiler 424 creates source codes edited by using editor 422 as programs executable in image forming apparatus 1.

Hard disk 420 further includes task registration setting information 430, a print module source 432, a sheet information module source 434, a sheet control module source 436, an image synchronization module source 442, a timing roller driving module source 444, and a TOD control module source 446. These sources are implemented as the various modules shown in FIG. 5 by being compiled by compiler 424.

Task registration setting information 430 defines an activation cycle, priority, and the like of each task. Print module source 432 describes source codes for exercising overall control of all the print sequences in image forming apparatus 1. Since all the print sequences do not significantly differ in their control procedures between different models, print module source 432 created for a certain model can be utilized for another model as well.

Sheet information module source 434 describes source codes for queuing information for each single sheet. Since the sizes of the sheets for use in image forming apparatus 1 are prescribed based on standards, sheet information module source 434 created for a certain model can be utilized for another model as well.

Sheet control module source 436 describes source codes for executing a series of sequences related to feeding, conveyance, and ejection of a sheet. These sheet-related sequences do not significantly depend on the model of the image forming apparatus, and can be implemented by substantially the same processing. Therefore, sheet control module source 436 created for a certain model can be utilized for another model as well.

On the other hand, image synchronization module source 442 describes source codes for controlling image synchronization control-related timing. As described with reference to FIG. 3, this image synchronization control-related timing varies depending on a physical positional relation between print engine 2 and the mechanism for conveying sheet S, a conveyance speed, and the like. That is, image synchronization module source 442 needs to be designed for each target model. It is noted, however, that personal computer 400 according to the present embodiment is provided with an image synchronization parameter 440 as a configuration for setting the image synchronization control-related timing of image synchronization module source 442.

Image synchronization parameter 440 can describe parameters defining the timing as shown in FIGS. 3, 4A and 4B, for each image synchronization identifier. Therefore, it is possible to easily develop software dependent on each model by re-writing the contents of image synchronization parameter 440, without significantly modifying the source codes of image synchronization module source 442.

Examples of types of parameters to be described in image synchronization parameter 440 typically include the following.

(1) A time period from the time when the formation of a toner image on a sheet has become possible until start of either timing control shown in FIG. 4A and/or FIG. 4B (in FIG. 7, the time period from the time when the image synchronization control has become possible until output of the image synchronization instruction (the time period from sequence 1.1.4 to sequence 1.1.5)).

(2) A time period from the start of timing control related to the mode shown in FIG. 4A until output of the TOD signal.

(3) A time period from the generation of the TOD signal until the generation of the driving start signal (in FIG. 4A, the time period from transition of the TOD signal to ON until transition of the timing roller signal to ON).

(4) A time period until generation of the driving start signal of the timing related to the mode shown in FIG. 4B.

(5) A time period from the generation of the driving start signal until the generation of the TOD signal (In FIG. 4B, the time period from transition of the timing roller signal to ON until transition of the TOD signal to ON).

Timing roller driving module source 444 describes source codes for driving a load such as timing roller 45. If the number of rollers is the same, in such a sequence for driving timing roller 45, substantially the same processing is performed. Therefore, timing roller driving module source 444 created for a certain model can be utilized for another model as well.

As described above, information designated by an image synchronization identifier is determined based on an image formation position in print engine 2 (image forming unit) and a position where timing roller 45 is disposed in the sheet conveying unit.

TOD control module source 446 describes source codes for performing output control of the TOD signal. Such output control of the TOD signal does not depend on the model, and is implemented by substantially the same processing. Therefore, TOD control module source 446 created for a certain model can be utilized for another model as well.

As described above, in the development environment according to the present embodiment, many of modified portions resulting from differences in mechanism among models are accommodated by the settings of image synchronization module source 442 and image synchronization parameter 440. Therefore, reusability of the modules (and the source codes thereof) other than image synchronization module 302 in another model can be improved.

[H. Another Aspect]

According to another aspect of the present invention, the image forming apparatus can also be expressed as follows.

The image forming apparatus according to one aspect of the present invention has installed therein software that performs synchronization control for synchronizing the timing for forming an image on a sheet and an image forward end. The present software includes a TOD control module that controls the output of an image synchronization signal (TOD signal), a timing roller driving module that performs driving control of a timing roller, a sheet information module that creates an image synchronization identifier for specifying image synchronization control (image synchronization sequence) for a corresponding single sheet, a sheet control module that determines synchronization timing between the image and the sheet, and an image synchronization module. The image synchronization module determines which of first image synchronization control and second image synchronization control is to be used, based on the image synchronization identifier created by the sheet information module. In the first image synchronization control, conveyance of the sheet is started after the output of the TOD signal from the TOD control module. In the second image synchronization control, the TOD signal is output after an instruction is given to convey the sheet from the timing roller driving module. The image synchronization module is activated at the synchronization timing determined by the sheet control module.

Preferably, the image synchronization module, the TOD control module, and the timing roller driving module can be activated from a task different from that of the sheet control module. An image synchronization mechanism can be controlled in a cycle shorter than a reference cycle of the sheet control module.

Preferably, the image synchronization identifier is determined based on an image formation position in the image forming apparatus and a position where the timing roller is conveyed.

Preferably, the image synchronization identifier is determined based on a selected color mode (distinction between color printing and monochrome printing).

The image synchronization module as a module interface includes a main function that is constantly periodically activated from a task having a cycle shorter than a cycle in which the sheet control module is controlled, a synchronization instruction-receiving function for receiving starting and stopping of image synchronization control, a driving state reference function for revealing its own control state, and an initialization function that receives initialization at the time of system start-up.

Preferably, the image synchronization module can be designed to have, as parameters, a time period from reception of a synchronization start instruction until start of the first or second image synchronization control, a time period from the start of control in the first control until output of the TOD signal, a time period from the output of the TOD signal until start of conveyance of the sheet, a time period from the start of control in the second control until the start of conveyance of the sheet, and a time period from the start of conveyance of the sheet until the output of the TOD signal.

[I. Advantages]

According to the present embodiment, by adopting the module configuration as described above, there is no need to customize software, reflecting a change in program present depending on a structural difference in image forming apparatus (between models), with respect to the software related to synchronization control between a toner image and a sheet onto which the toner image is to be fixed. By reconsidering the module configurations and the function of each module as described above, it is possible to improve reusability for each module unit to enhance the productivity of software development.

In summary, according to the present embodiment, by adapting image synchronization module 302 to accommodate a difference in control sequence resulting from a structural difference in image forming apparatus, there is no need to make design modifications to the modules other than image synchronization module 302. Furthermore, device driver modules such as timing roller driving module 304 and TOD control module 306 can be divided into components. This enhances reusability for each module unit.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

an image forming unit configured to form a toner image based on an input image;

a sheet conveying unit configured to convey a sheet by driving a timing roller;

a TOD (Top of Data) control module configured to instruct said image forming unit to start generating the toner image;

a timing roller driving module configured to instruct said sheet conveying unit to start driving of said timing roller;

an image synchronization module for activating said TOD control module and said timing roller driving module, on a basis of a physical positional relation of said sheet conveying unit and said image forming unit; and a sheet information module configured to generate an image synchronization identifier for designating a pattern of image synchronization control related to printing of the toner image on the sheet, depending on a type of the sheet designated, wherein said image synchronization module is configured to be activated when formation of the toner image on the sheet has become possible, and activate each of said TOD control module and said timing roller driving module, with a relative time lag based on said image synchronization identifier, and switch, based on said image synchronization identifier, between (i) a first mode, in which a driving start signal is generated for instructing start of driving said timing roller-from said timing roller driving module after an image synchronization signal is generated from said TOD control module for instructing start of generation of the toner image, and (ii) a second mode, in which said image synchronization signal is generated from said TOD control module after said driving start signal is generated from said timing roller driving module.

2. The image forming apparatus according to claim 1, further comprising a sheet control module for controlling a sequence related to an image forming process for a sheet, wherein said sheet control module is configured to activate said image synchronization module when the formation of the toner image in said image forming unit and conveyance of the sheet by said sheet conveying unit are both possible.

3. The image forming apparatus according to claim 2, wherein said sheet control module is configured to be activated as a first task activated in a first cycle, and each of said image synchronization module, said TOD control module, and said timing roller driving module is configured to be activated as a second task activated in a second cycle shorter than the first cycle.

4. The image forming apparatus according to claim 3, wherein said image synchronization module as a module interface includes a function constantly periodically activated from said second task, a function for receiving starting and stopping of image synchronization control, a function for revealing a control state of said image synchronization module itself, and a function for receiving initialization at system start-up.

5. The image forming apparatus according to claim 1, wherein information designated by said image synchronization identifier is determined based on an image formation position in said image forming unit and a position where the timing roller is disposed in said sheet conveying unit.

6. The image forming apparatus according to claim 1, wherein said sheet information module is configured to determine said image synchronization identifier depending on a color mode.

7. The image forming apparatus according to claim 1, wherein said image synchronization module is designed to have, as parameters, a time period from time when formation of the toner image on the sheet has become possible until start of said first mode or said second mode, a time period from start of said first mode until generation of said image synchronization signal, a time period from the generation of said image synchronization signal until generation of said driving start signal, a time period from start of said second mode until generation of said driving start signal, and a time period from the generation of said driving start signal until generation of said image synchronization signal.

* * * * *